US010495324B2

(12) United States Patent
D'Souza

(10) Patent No.: US 10,495,324 B2
(45) Date of Patent: Dec. 3, 2019

(54) PACKAGED TERMINAL AIR CONDITIONER UNIT

(71) Applicant: Haier US Appliance Solutions, Inc., Wilmington, DE (US)

(72) Inventor: Bryan Isaac D'Souza, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 192 days.

(21) Appl. No.: 15/842,109

(22) Filed: Dec. 14, 2017

(65) Prior Publication Data

US 2019/0186760 A1 Jun. 20, 2019

(51) Int. Cl.

| | |
|---|---|
| ***F24F 1/022*** | (2019.01) |
| ***F25B 30/02*** | (2006.01) |
| *F24F 11/84* | (2018.01) |

(52) U.S. Cl.

CPC ..... *F24F 1/022* (2013.01); *F25B 30/02* (2013.01); *F24F 11/84* (2018.01)

(58) Field of Classification Search

CPC .... F24F 1/02; F24F 1/022; F24F 1/027; F24F 11/83; F24F 11/84; F25B 30/02; F25B 5/00; F25B 5/02; F25B 49/02; F25B 41/04; F25B 41/06; F25B 41/062; F25B 13/00; F25B 2600/2513; F25B 2600/2511

See application file for complete search history.

(56) References Cited

U.S. PATENT DOCUMENTS

| | | | | |
|---|---|---|---|---|
| 3,866,439 A * | 2/1975 | Bussjager | ..... | F25B 39/02 62/504 |
| 4,745,770 A * | 5/1988 | Mintz | ..... | F24F 1/027 62/237 |
| 8,113,009 B2 * | 2/2012 | Kuriyama | ..... | H05K 7/20745 361/696 |
| 2010/0000245 A1 * | 1/2010 | Kasahara | ..... | F25B 9/008 62/222 |

FOREIGN PATENT DOCUMENTS

| | | |
|---|---|---|
| CN | 103206748 B | 11/2015 |
| JP | H109644 A | 1/1998 |
| JP | 2008151394 A | 7/2008 |

* cited by examiner

*Primary Examiner* — Joseph F Trpisovsky
(74) *Attorney, Agent, or Firm* — Dority & Manning, P.A.

(57) ABSTRACT

A packaged terminal air conditioner unit includes a main expansion device connected to an interior coil such that the main expansion device is operable to throttle a flow of refrigerant to both a first coil section and a second coil section of the interior coil. A secondary expansion device is connected in series between the main expansion device and the second coil section of the interior coil such that the secondary expansion device is operable to throttle a flow of refrigerant to the second coil section of the interior coil. A controller is in operative communication with the secondary expansion device such that the controller adjusts the secondary expansion device to a configuration between a fully open configuration and a fully closed configuration during operation of the compressor.

17 Claims, 4 Drawing Sheets

PACKAGED TERMINAL AIR CONDITIONER UNIT

FIELD OF THE INVENTION

The present subject matter relates generally to packaged terminal air conditioner units.

BACKGROUND OF THE INVENTION

Packaged terminal air conditioner units generally include a casing and a sealed system within the casing. The sealed system includes components for chilling and/or heating air with refrigerant. For example, heat exchange between air around an indoor heat exchanger of the sealed system and refrigerant flowing through the indoor heat exchanger can chill or heat the air. Optimizing the throttling of refrigerant flowing through the indoor heat exchanger can be difficult.

Accordingly, a packaged terminal air conditioner unit with features for suitably throttling refrigerant flowing through an indoor heat exchanger of the packaged terminal air conditioner unit would be useful.

BRIEF DESCRIPTION OF THE INVENTION

The present subject matter provides a packaged terminal air conditioner unit. The packaged terminal air conditioner unit includes a main expansion device connected to an interior coil such that the main expansion device is operable to throttle a flow of refrigerant to both a first coil section and a second coil section of the interior coil. A secondary expansion device is connected in series between the main expansion device and the second coil section of the interior coil such that the secondary expansion device is operable to throttle a flow of refrigerant to the second coil section of the interior coil. A controller is in operative communication with the secondary expansion device such that the controller adjusts the secondary expansion device to a configuration between a fully open configuration and a fully closed configuration during operation of the compressor. Additional aspects and advantages of the invention will be set forth in part in the following description, or may be apparent from the description, or may be learned through practice of the invention.

In a first example embodiment, a packaged terminal air conditioner unit is provided. The packaged terminal air conditioner unit includes a casing. A compressor is positioned within the casing. The compressor is operable to increase a pressure of a refrigerant. An interior coil is positioned within the casing. The interior coil includes a first coil section and a second coil section. The first and second coil sections are connected in parallel within the interior coil. An exterior coil is positioned within the casing opposite the interior coil. A main expansion device positioned within the casing. The main expansion device is connected to the interior coil such that the main expansion device is operable to throttle a flow of refrigerant to both the first and second coil sections of the interior coil. A secondary expansion device is positioned within the casing. The secondary expansion device is connected in series between the main expansion device and the second coil section of the interior coil such that the secondary expansion device is operable to throttle a flow of refrigerant to the second coil section of the interior coil. The secondary expansion device is adjustable between a fully open configuration and a fully closed configuration. The flow of refrigerant through secondary expansion device is maximized when the secondary expansion device is in the fully open configuration, and the flow of refrigerant through secondary expansion device is minimized when the secondary expansion device is in the fully closed configuration. A controller is in operative communication with the secondary expansion device such that the controller adjusts the secondary expansion device to a configuration between the fully open configuration and the fully closed configuration during operation of the compressor.

In a second example embodiment, a packaged terminal air conditioner unit is provided. The packaged terminal air conditioner unit includes a casing that extends between an exterior side portion and an interior side portion. A compressor is positioned within the casing. The compressor is operable to compress a refrigerant. An interior coil is positioned within the casing at the interior side portion of the casing. The interior coil includes a first coil section and a second coil section. The first and second coil sections are plumbed in parallel within the interior coil. An exterior coil is positioned within the casing at the exterior side portion of the casing. A main expansion device is positioned within the casing. The main expansion device is connected to the interior coil such that the main expansion device is operable to throttle a flow of refrigerant to both the first and second coil sections of the interior coil. A secondary expansion device is also positioned within the casing. The secondary expansion device is connected in series between the main expansion device and the second coil section of the interior coil such that the secondary expansion device is operable to throttle a flow of refrigerant to the second coil section of the interior coil. The secondary expansion device is adjustable between a fully open configuration and a fully closed configuration. The flow of refrigerant through secondary expansion device is maximized when the secondary expansion device is in the fully open configuration, and the flow of refrigerant through secondary expansion device is minimized when the secondary expansion device is in the fully closed configuration. A controller is in operative communication with the secondary expansion device such that the controller adjusts the secondary expansion device to a configuration between the fully open configuration and the fully closed configuration during operation of the compressor.

In a third example embodiment, a method for operating a packaged terminal air conditioner unit is provided. The method includes running a compressor of the packaged terminal air conditioner unit in order to compress refrigerant with the compressor, throttling the compressed refrigerant with a main expansion device of the packaged terminal air conditioner unit and flowing the throttled refrigerant towards a first coil section and a second coil section of an interior coil of the packaged terminal air conditioner unit. The first and second coil sections are plumbed in parallel within the interior coil. The method also includes, prior to the throttled refrigerant from the main expansion device entering the second coil section of the interior coil, passing the throttled refrigerant through a secondary expansion device. The secondary expansion device is adjusted to a configuration between a fully open configuration and a fully closed configuration. The compressor, the main expansion device, the secondary expansion device and the interior coil are positioned within a casing of the packaged terminal air conditioner unit. The flow of throttled refrigerant to the second coil section of the interior coil is maximized when the secondary expansion device is in the fully open configuration, and the flow of throttled refrigerant to the second coil section of the interior coil is minimized when the secondary expansion device is in the fully closed configuration.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
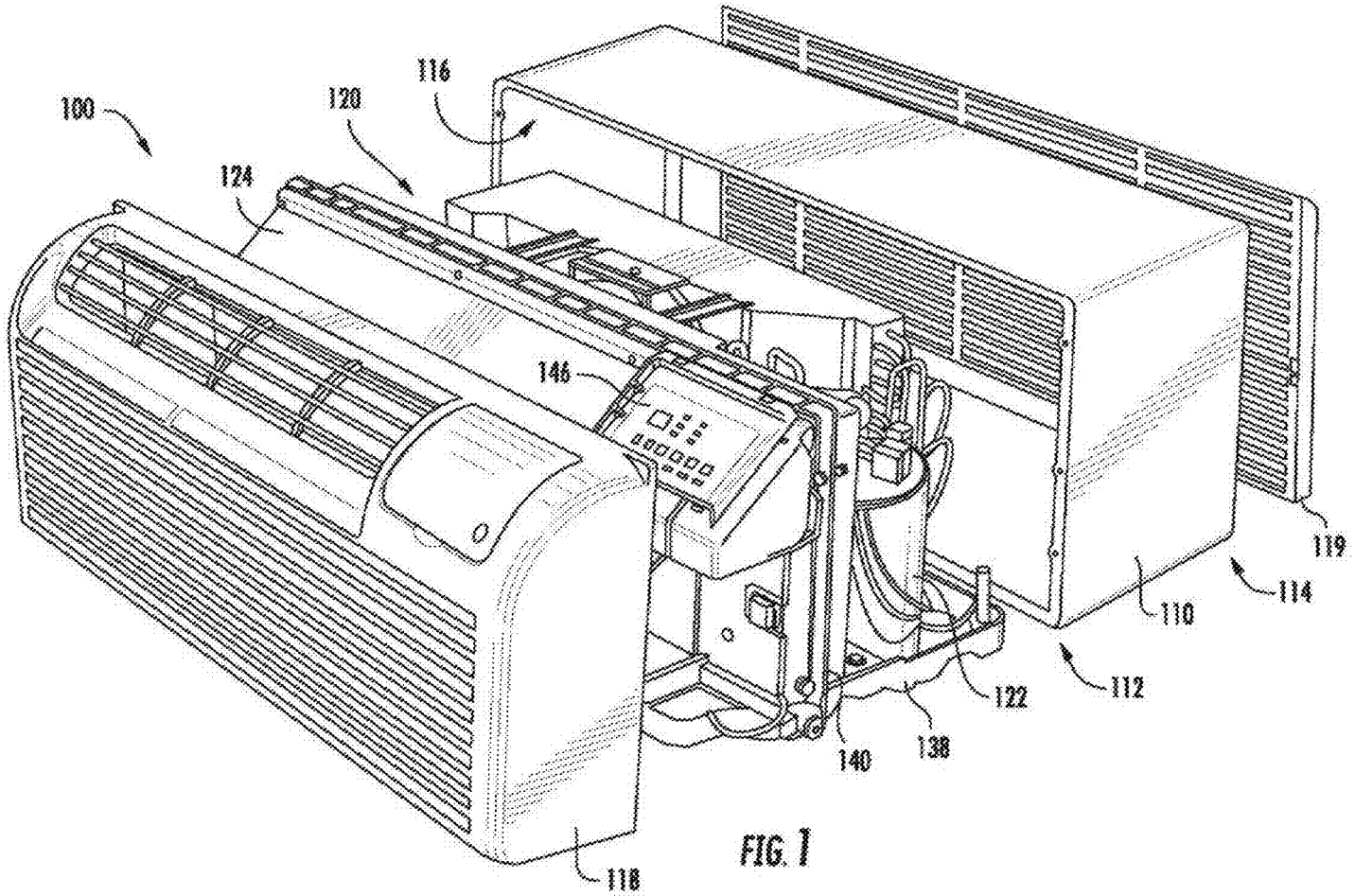
FIG. 1 is an exploded perspective view of a packaged terminal air conditioner unit according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an example embodiment of the present subject matter. Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere, as discussed in greater detail below.

Casing 110 defines a mechanical compartment 116. Sealed system 120 is disposed or positioned within mechanical compartment 116 of casing 110. A front panel 118 and a rear grill or screen 119 are mounted to casing 110 and hinder or limit access to mechanical compartment 116 of casing 110. Front panel 118 is mounted to casing 110 at interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall 140 positioned within mechanical compartment 116 of casing 110. Sealed system 120 is positioned on bottom tray 138. Thus, liquid runoff from sealed system 120 may flow into and collect within bottom tray 138. Inner wall 140 may be mounted to bottom tray 138 and extend upwardly from bottom tray 138 to a top wall of casing 110. Inner wall 140 limits or prevents air flow between interior side portion 112 of casing 110 and exterior side portion 114 of casing 110 within mechanical compartment 116 of casing 110. Thus, inner wall 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
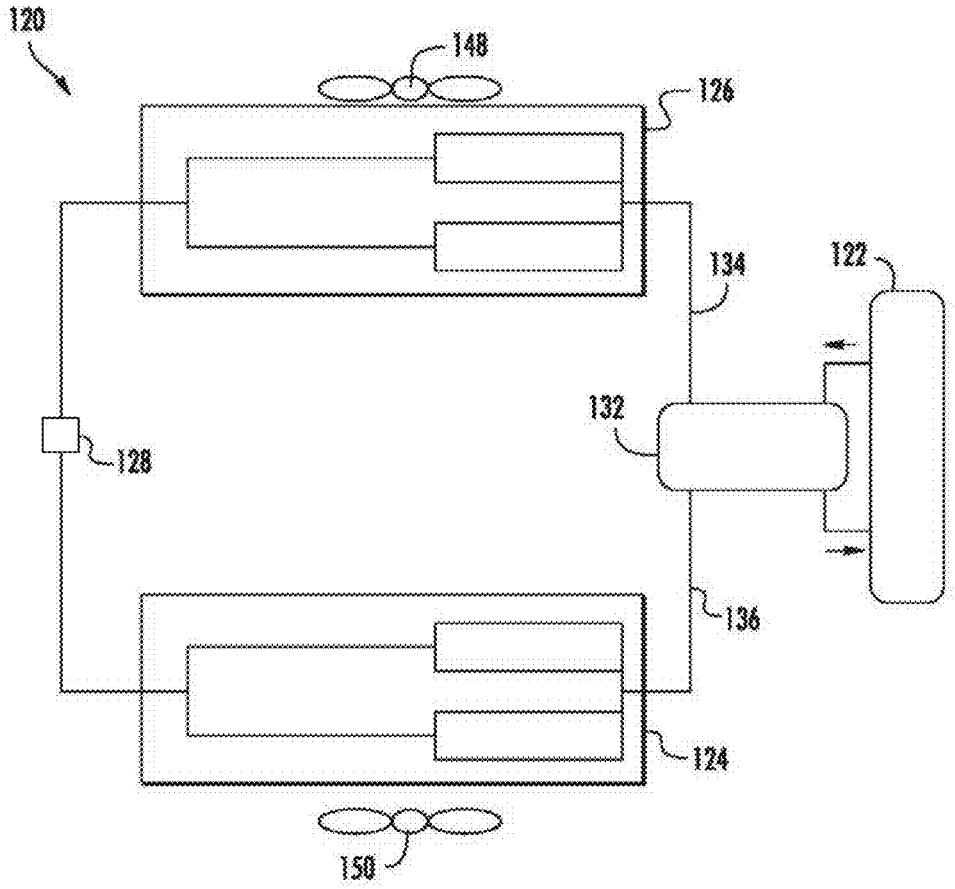
FIG. 2 is a schematic view of certain components of the example packaged terminal air conditioner unit of FIG. 1.

FIG. 2 provides a schematic view of certain components of packaged terminal air conditioner unit 100, including sealed system 120. Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 2, sealed system 120 also includes a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 148 is positioned adjacent exterior coil 126 may facilitate or urge a flow of air from the exterior atmosphere across exterior coil 126 in order to facilitate heat transfer.

Sealed system 120 also includes an expansion device 128 disposed between interior coil 124 and exterior coil 126, e.g., on a tube that extends between and fluidly couples interior coil 124 and exterior coil 126. Refrigerant, which may be in the form of high liquid quality/saturated liquid vapor mixture, may exit exterior coil 126 and travel through expansion device 128 before flowing through interior coil 124. Expansion device 128 may generally expand the refrigerant, lowering the pressure and temperature thereof. The refrigerant may then be flowed through interior coil 124.

Interior coil 124 is disposed downstream of expansion device 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, a second distribution conduit 136 extends between and fluidly connects interior coil 124 and reversing valve 132, and the liquid or liquid vapor mixture refrigerant from expansion device 128 may enter interior coil 124 via second distribution conduit 136. Within interior coil 124, the refrigerant from expansion device 128 receives energy from the interior atmosphere and vaporizes into superheated vapor and/or high quality vapor mixture. An interior air handler or fan 150 is positioned adjacent interior coil 124 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of expansion device 128 in the heating mode and acts as an evaporator, e.g., such that exterior coil 126 is operable to heat refrigerant within exterior coil 126 with energy from the exterior atmosphere at exterior side portion 114 of casing 110.

It should be understood that sealed system 120 described above is provided by way of example only. In alternative example embodiments, sealed system 120 may include any suitable components for heating and/or cooling air with a refrigerant. Similarly, sealed system 120 may have any suitable arrangement or configuration of components for heating and/or cooling air with a refrigerant in alternative example embodiments.

Figure 3:
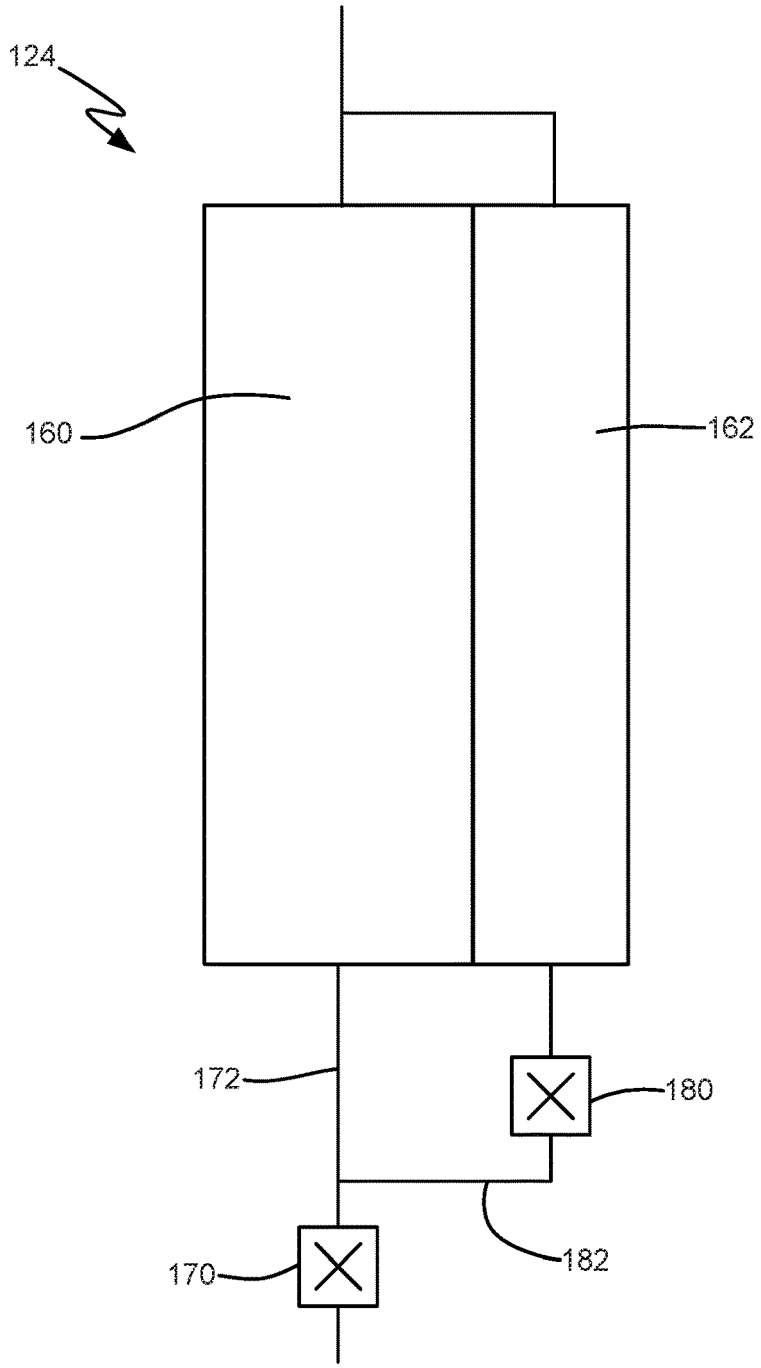
FIG. 3 is a schematic view of an interior coil and expansion devices of the example packaged terminal air conditioner unit of FIG. 1.

FIG. 3 provides a schematic view of interior coil 124, a primary expansion device 170 and a secondary expansion device 180 of sealed system 120. The components shown in FIG. 3 may all be positioned within casing 110. Primary and secondary expansion devices 170, 180 may each be an electronic expansion valve (EEV) in certain example embodiments. Thus, e.g., controller 146 may be in operative communication with primary and secondary expansion devices 170, 180, and controller 146 may regulate the throttling of refrigerant through primary and secondary expansion devices 170, 180. Primary and secondary expansion devices 170, 180 may collectively form expansion device 128 shown in FIG. 2.

As shown in FIG. 3, interior coil 124 includes a first coil section 160 and a second coil section 162. First and second coil sections 160, 162 are connected or plumbed in parallel within interior coil 124. Thus, expanded refrigerant from primary expansion device 170 may flow through interior coil 124 by first coil section 160 or by second coil section 162.

By dividing interior coil 124 into first and second coil sections 160, 162, performance of interior coil 124 may be improved relative to a heat exchanger with a single flow path. For example, first coil section 160 may be positioned closer to interior side portion 112 of casing 110 and may thus correspond to a front section of interior coil 124. In contrast, second coil section 162 may be positioned between first coil section 160 and exterior coil 126 within casing 110 and may thus correspond to a rear section of interior coil 124. In such an arrangement, air from the interior atmosphere may first flow across first coil section 160 and then flow across second coil section 162. As discussed in greater detail below, primary expansion device 170 and secondary expansion device 180 may cooperate to suitably throttle refrigerant flowing through first and second coil sections 160, 162.

Main expansion device 170 is connected to interior coil 124. In particular, main expansion device 170 may be connected to a main line 172 that extends to first coil section 160 of interior coil 124. Thus, expanded refrigerant from main expansion device 170 may flow to first coil section 160 of interior coil 124 through main line 172. In addition, a secondary line 182 extends from main line 172 to second coil section 162 of interior coil 124, and the expanded refrigerant from main expansion device 170 may flow to second coil section 162 of interior coil 124 through secondary line 182. Thus, main expansion device 170 is operable to throttle a flow of refrigerant to both first and second coil sections 160, 162 of interior coil 124.

Secondary expansion device 180 is connected in series between main expansion device 170 and second coil section 162 of interior coil 124. For example, secondary expansion device 180 may be positioned on or connected to secondary line 182 between main expansion device 170 and second coil section 162 of interior coil 124. Thus, secondary expansion device 180 is operable to throttle a flow of refrigerant to second coil section 162 of interior coil 124. For example, in the cooling mode, secondary expansion device 180 is operable to throttle a flow of expanded refrigerant from main expansion device 170 to second coil section 162 of interior coil 124.

Secondary expansion device 180 may be adjustable between a fully open configuration and a fully closed configuration. The flow of refrigerant through secondary expansion device 180 is maximized when the secondary expansion device is in the fully open configuration, and the flow of refrigerant through secondary expansion device 180 is minimized when the secondary expansion device 180 is in the fully closed configuration. Thus, in the cooling mode, the flow of expanded refrigerant from main expansion device 170 to second coil section 162 of interior coil 124 is maximized when the secondary expansion device 180 is in the fully open configuration, and the flow of expanded refrigerant from main expansion device 170 to second coil section 162 of interior coil 124 is minimized when the secondary expansion device 180 is in the fully closed configuration. It will be understood that secondary expansion device 180 may be adjustable to throttle the flow of refrigerant through secondary expansion device 180 to any suitable degree between the fully open configuration and the fully closed configuration.

Controller 146 is in operative communication with secondary expansion device 180. Thus, controller 146 may command secondary expansion device 180 to adjust the configuration of secondary expansion device 180 between the fully open configuration and the fully closed configuration. In particular, controller 146 may adjust secondary expansion device 180 to a configuration between the fully open configuration and the fully closed configuration during operation of compressor 122.

Figure 4:
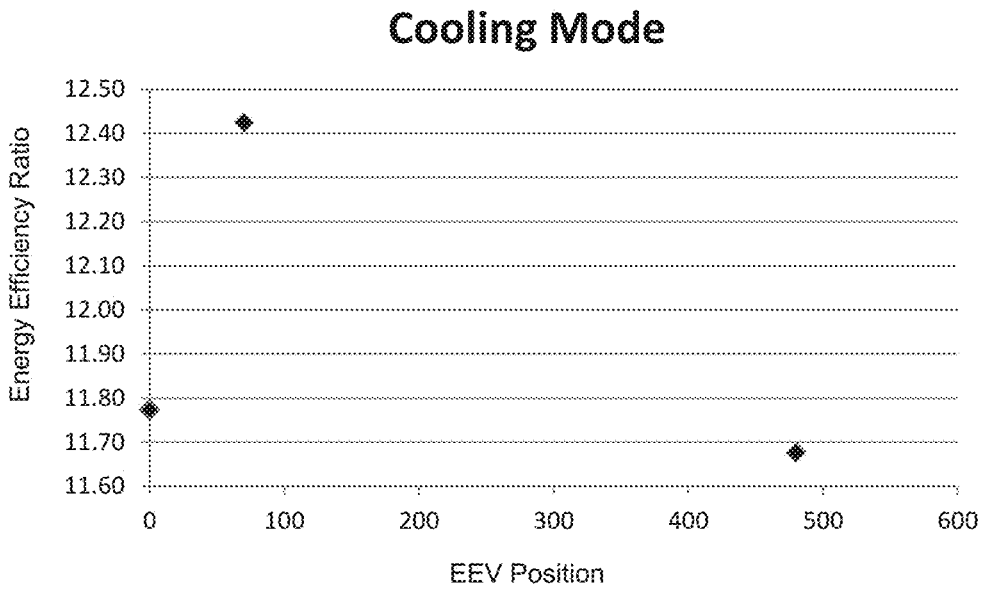
FIG. 4 is a plot of a secondary expansion device setting versus energy efficiency ratio during the operation of an example packaged terminal air conditioner unit in a cooling mode.
Figure 5:
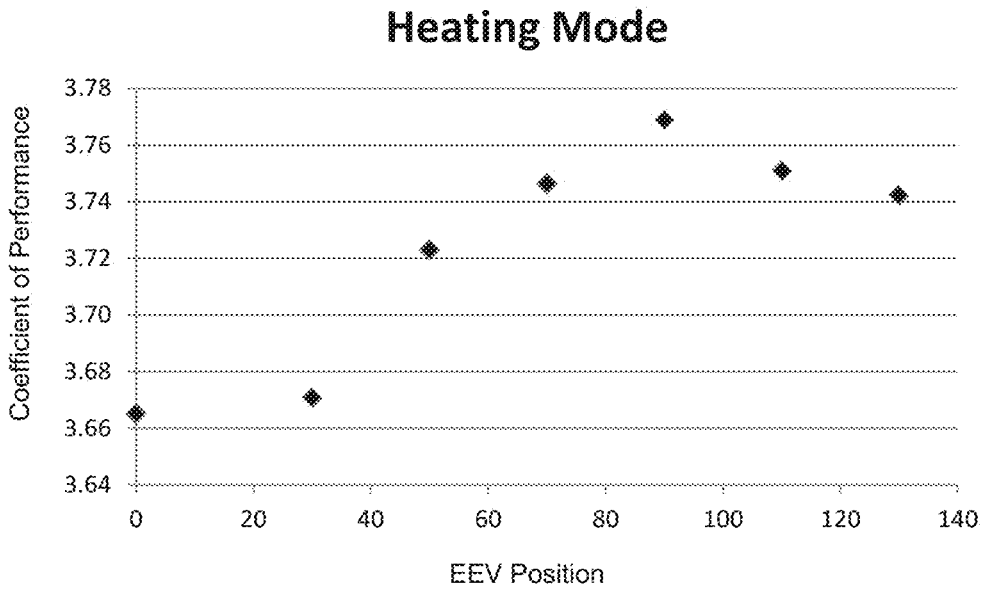
FIG. 5 is a plot of a secondary expansion device setting versus a coefficient of performance during the operation of an example packaged terminal air conditioner unit in a heating mode.

The configuration between the fully open configuration and the fully closed configuration is selected to increase an efficiency of the packaged terminal air conditioner unit 100 relative to when secondary expansion device 180 is in the fully open configuration or the fully closed configuration. Such efficiency increase is discussed in greater detail below with reference to FIGS. 4 and 5. In FIGS. 4 and 5, secondary expansion device 180 is an electronic expansion valve that is adjustable between a zero (0) setting and a four hundred and seventy (470) setting, with the zero setting corresponding to the fully closed configuration and the four hundred and seventy setting corresponding to the fully open configuration.

As shown in FIG. 4, when packaged terminal air conditioner unit 100 is operating in the cooling mode, the energy efficiency ratio is maximized at a seventy (70) setting of secondary expansion device 180. Thus, packaged terminal air conditioner unit 100 operates more efficiently in the cooling mode when secondary expansion device 180 partially throttles refrigerant flowing from main expansion device 170 to second coil section 162 of interior coil 124. Similarly, with reference to FIG. 5, the coefficient of performance is maximized at a ninety (90) setting of secondary expansion device 180 when packaged terminal air conditioner unit 100 is operating in the heating mode. Thus, packaged terminal air conditioner unit 100 operates more efficiently in the heating mode when secondary expansion device 180 partially throttles refrigerant flowing from second coil section 162 of interior coil 124 to main expansion device 170.

While not wishing to be bound to any particular theory, the throttling provided by secondary expansion device 180 in the cooling mode may help further reduce the temperature of air flowing through interior coil 124 at second coil section 162. In addition, the colder second coil section 162 may also draw more moisture out of the air flowing through interior coil 124 and provide improved dehumidification. The additional moisture removal may be result in some of the improved performance associated with the throttling provided by secondary expansion device 180. In particular, the moisture from interior coil 124 may be collected and flung onto exterior coil 126 which lowers the temperature of exterior coil 126 and lowers the power consumption required by compressor 122. In the heating mode, the effect does not include moisture, and the results show that there is an optimal operating point (partially throttled) between high refrigerant flow at a lower saturation temperature (secondary expansion device 180 fully open) and little/no refrigerant flow at a higher saturation temperature (secondary expansion device 180 fully closed).

It will be understood that the plots shown in FIGS. 4 and 5 and the specific settings described above are provided by way of example only. Thus, in the heating mode, controller 146 may adjust secondary expansion device 180 to a first configuration between the fully open configuration and the fully closed configuration in the heating mode of the packaged terminal air conditioner unit in order to increase an efficiency of packaged terminal air conditioner unit 100 relative to when secondary expansion device 180 is in the fully open configuration and the fully closed configuration. Similarly, in the cooling mode, controller 146 may adjust secondary expansion device 180 to a second configuration between the fully open configuration and the fully closed configuration in the heating mode of the packaged terminal air conditioner unit in order to increase an efficiency of packaged terminal air conditioner unit 100 relative to when secondary expansion device 180 is in the fully open configuration and the fully closed configuration. The first and second configurations may be any suitable configuration between the fully open configuration and the fully closed configuration depending upon the particular arrangement and construction of packaged terminal air conditioner unit 100. In certain example embodiments, the first configuration may be closer to the fully open configuration than the second configuration.

As may be seen from the above, indoor coil 124 has a front or first coil section 160 and a rear or second coil section 162 that is downstream of first coil section 160 on the airflow through indoor coil 124. The refrigerant that passes through first coil section 160 flows through main expansion device 170, and the refrigerant that passes through second coil section 162 passes through both main expansion device 170 and secondary expansion device 180 in series. Given that the main expansion device 170 already throttles refrigerant flowing to second coil section 162, the optimal restriction level between the fully open configuration and the fully closed configuration for the secondary expansion device 180 may be selected to increase performance of packaged terminal air conditioner unit 100. In particular, the restriction level provided by secondary expansion device 180 may be selected to optimize the heat transfer for the whole interior coil 124, i.e., both the first and second coil sections 160, 162 as a combined unit.

Providing some amount of throttling with secondary expansion device 180 results in the most optimal configuration for overall unit performance in terms of capacity and efficiency when using a split indoor heat exchanger design. Inferior results were seen when opening secondary expansion device 180 to the fully open configuration as well as when closing secondary expansion device 180 to the fully closed configuration. This effect is seen in both traditional air conditioning operation as well as reverse-cycle heat pump operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit, comprising:

a casing;

a compressor positioned within the casing, the compressor operable to increase a pressure of a refrigerant;

an interior coil positioned within the casing, the interior coil comprising a first coil section and a second coil section, the first and second coil sections connected in parallel within the interior coil;

an exterior coil positioned within the casing opposite the interior coil;

a main expansion device positioned within the casing, the main expansion device connected to the interior coil such that the main expansion device is operable to throttle a flow of refrigerant to both the first and second coil sections of the interior coil;

a secondary expansion device positioned within the casing, the secondary expansion device connected in series between the main expansion device and the second coil section of the interior coil such that the secondary expansion device is operable to throttle a flow of refrigerant to the second coil section of the interior coil, the secondary expansion device adjustable between a fully open configuration and a fully closed configuration, the flow of refrigerant through secondary expansion device being maximized when the secondary expansion device is in the fully open configuration, the flow of refrigerant through secondary expansion device being minimized when the secondary expansion device is in the fully closed configuration; and a controller in operative communication with the secondary expansion device such that the controller adjusts the secondary expansion device to a configuration between the fully open configuration and the fully closed configuration during operation of the compressor.

2. The packaged terminal air conditioner unit of claim 1, wherein the configuration between the fully open configuration and the fully closed configuration is selected to increase an efficiency of the packaged terminal air conditioner unit relative to when the secondary expansion device is in the fully open configuration or the fully closed configuration.

3. The packaged terminal air conditioner unit of claim 1, wherein the second coil section of the interior coil is positioned between the first coil section of the interior coil and the exterior coil within the casing.

4. The packaged terminal air conditioner unit of claim 1, further comprising a reversing valve positioned within the casing, the reversing valve operable to selectively direct the pressurized refrigerant from the compressor to either the interior coil or the exterior coil, wherein the controller is in operative communication with the reversing valve, the controller configured to adjust the reversing valve such that the reversing valve directs the pressurized refrigerant from the compressor to the exterior coil in a cooling mode of the packaged terminal air conditioner unit, the controller configured to adjust the reversing valve such that the reversing valve directs the pressurized refrigerant from the compressor to the interior coil in a heating mode of the packaged terminal air conditioner unit.

5. The packaged terminal air conditioner unit of claim 4, wherein the controller adjusts the secondary expansion device to a first configuration between the fully open configuration and the fully closed configuration in the heating mode of the packaged terminal air conditioner unit, wherein the controller adjusts the secondary expansion device to a second configuration between the fully open configuration and the fully closed configuration in the cooling mode of the packaged terminal air conditioner unit.

6. The packaged terminal air conditioner unit of claim 5, wherein the first configuration between the fully open configuration and the fully closed configuration is selected to increase a coefficient of performance of the packaged terminal air conditioner unit relative to when the secondary expansion device is in the fully open configuration or the fully closed configuration.

7. The packaged terminal air conditioner unit of claim 5, wherein the second configuration between the fully open configuration and the fully closed configuration is selected to increase an energy efficiency ratio of the packaged terminal air conditioner unit relative to when the secondary expansion device is in the fully open configuration or the fully closed configuration.

8. A packaged terminal air conditioner unit, comprising:

a casing extending between an exterior side portion and an interior side portion;

a compressor positioned within the casing, the compressor operable to compress a refrigerant;

an interior coil positioned within the casing at the interior side portion of the casing, the interior coil comprising a first coil section and a second coil section, the first and second coil sections plumbed in parallel within the interior coil;

an exterior coil positioned within the casing at the exterior side portion of the casing;

a main expansion device positioned within the casing, the main expansion device connected to the interior coil such that the main expansion device is operable to throttle a flow of refrigerant to both the first and second coil sections of the interior coil;

a secondary expansion device positioned within the casing, the secondary expansion device connected in series between the main expansion device and the second coil section of the interior coil such that the secondary expansion device is operable to throttle a flow of refrigerant to the second coil section of the interior coil, the secondary expansion device adjustable between a fully open configuration and a fully closed configuration, the flow of refrigerant through secondary expansion device being maximized when the secondary expansion device is in the fully open configuration, the flow of refrigerant through secondary expansion device being minimized when the secondary expansion device is in the fully closed configuration; and a controller in operative communication with the secondary expansion device such that the controller adjusts the secondary expansion device to a configuration between the fully open configuration and the fully closed configuration during operation of the compressor.

9. The packaged terminal air conditioner unit of claim 8, wherein the configuration between the fully open configuration and the fully closed configuration is selected to increase an efficiency of the packaged terminal air conditioner unit relative to when the secondary expansion device is in the fully open configuration or the fully closed configuration.

10. The packaged terminal air conditioner unit of claim 8, wherein the second coil section of the interior coil is positioned between the first coil section of the interior coil and the exterior coil within the casing.

11. The packaged terminal air conditioner unit of claim 8, further comprising a reversing valve positioned within the casing, the reversing valve operable to selectively direct the pressurized refrigerant from the compressor to either the interior coil or the exterior coil, wherein the controller is in operative communication with the reversing valve, the controller configured to adjust the reversing valve such that the reversing valve directs the pressurized refrigerant from the compressor to the exterior coil in a cooling mode of the packaged terminal air conditioner unit, the controller configured to adjust the reversing valve such that the reversing valve directs the pressurized refrigerant from the compressor to the interior coil in a heating mode of the packaged terminal air conditioner unit.

12. The packaged terminal air conditioner unit of claim 11, wherein the controller adjusts the secondary expansion device to a first configuration between the fully open configuration and the fully closed configuration in the heating mode of the packaged terminal air conditioner unit, wherein the controller adjusts the secondary expansion device to a second configuration between the fully open configuration and the fully closed configuration in the cooling mode of the packaged terminal air conditioner unit.

13. The packaged terminal air conditioner unit of claim 12, wherein the first configuration between the fully open configuration and the fully closed configuration is selected to increase a coefficient of performance of the packaged terminal air conditioner unit relative to when the secondary expansion device is in the fully open configuration or the fully closed configuration.

14. The packaged terminal air conditioner unit of claim 12, wherein the second configuration between the fully open configuration and the fully closed configuration is selected to increase an energy efficiency ratio of the packaged terminal air conditioner unit relative to when the secondary expansion device is in the fully open configuration or the fully closed configuration.

15. A method for operating a packaged terminal air conditioner unit, comprising:

running a compressor of the packaged terminal air conditioner unit in order to compress refrigerant with the compressor, the compressor positioned within a casing of the packaged terminal air conditioner unit;

throttling the compressed refrigerant with a main expansion device of the packaged terminal air conditioner unit, the main expansion device positioned within the casing of the packaged terminal air conditioner unit;

flowing the throttled refrigerant towards a first coil section and a second coil section of an interior coil of the packaged terminal air conditioner unit, the interior coil positioned within the casing of the packaged terminal air conditioner unit, the first and second coil sections plumbed in parallel within the interior coil; and prior to the throttled refrigerant from the main expansion device entering the second coil section of the interior coil, passing the throttled refrigerant through a secondary expansion device, the secondary expansion device positioned within the casing, the secondary expansion device adjusted to a configuration between a fully open configuration and a fully closed configuration, the flow of throttled refrigerant to the second coil section of the interior coil being maximized when the secondary expansion device is in the fully open configuration, the flow of throttled refrigerant to the second coil section of the interior coil being minimized when the secondary expansion device is in the fully closed configuration.

16. The method for operating the packaged terminal air conditioner unit of claim 15, wherein the configuration between the fully open configuration and the fully closed configuration is selected to increase an efficiency of the packaged terminal air conditioner unit relative to when the secondary expansion device is in the fully open configuration or the fully closed configuration.

17. The method for operating the packaged terminal air conditioner unit of claim 15, wherein the second coil section of the interior coil is positioned between the first coil section of the interior coil and an exterior coil within the casing.

* * * * *